United States Patent [19]

Cooper et al.

[11] 4,366,408

[45] Dec. 28, 1982

[54] ARC DISCHARGE LAMP HAVING LARGE ANODE RADIATING SURFACE

[75] Inventors: Geoffrey A. Cooper; Donald W. Ward, both of Cambridge, England

[73] Assignee: Pye (Electronic Products) Ltd., Cambridge, England

[21] Appl. No.: 189,287

[22] Filed: Sep. 22, 1980

[30] Foreign Application Priority Data

Oct. 5, 1979 [GB] United Kingdom ..... 7934688

[51] Int. Cl.[3] ..... H01J 61/06; H01J 61/00

[52] U.S. Cl. ..... 313/193; 313/192

[58] Field of Search ..... 313/193, 192, 188

[56] References Cited

U.S. PATENT DOCUMENTS

| | | | |
|---|---|---|---|
| 1,893,887 | 1/1933 | Giard | 313/193 |
| 3,601,489 | 8/1971 | Gelder | 313/192 |
| 3,855,491 | 12/1974 | Yamasaki | 313/193 |

FOREIGN PATENT DOCUMENTS

| | | | |
|---|---|---|---|
| 883629 | 7/1943 | France | 313/193 |

*Primary Examiner*—Robert Segal

*Attorney, Agent, or Firm*—Robert S. Smith

[57] ABSTRACT

An electric arc discharge lamp comprises a cathode (2), an apertured diaphragm (4) and a cup shaped apertured anode (6). The anode (6) is provided with a flared extension (7) and is mounted on leads passing through ceramic tubes (14) (FIG. 4). The cathode (2) is enclosed in a cup shaped member comprising a cylindrical tube (5) having one end closed by the diaphragm (4). The electrodes are enclosed in a sealed envelope (8) (FIG. 4) which is filled with deuterium. A synthetic quartz window (81) is provided in one end of the envelope to enable ultra-violet radiation from the arc struck between the cathode and anode to pass through.

The cathode (2), the aperture (42) in the diaphragm (4) and the aperture (62) in the anode (6) are aligned and lie on the axis of symmetry of the envelope (8). The anode is an efficient heat radiator because of its large surface area and thus works at a lower than normal temperature allowing the use of stainless steel rather than the usual refractory metals.

9 Claims, 4 Drawing Figures

ARC DISCHARGE LAMP HAVING LARGE ANODE RADIATING SURFACE

Figure 1:
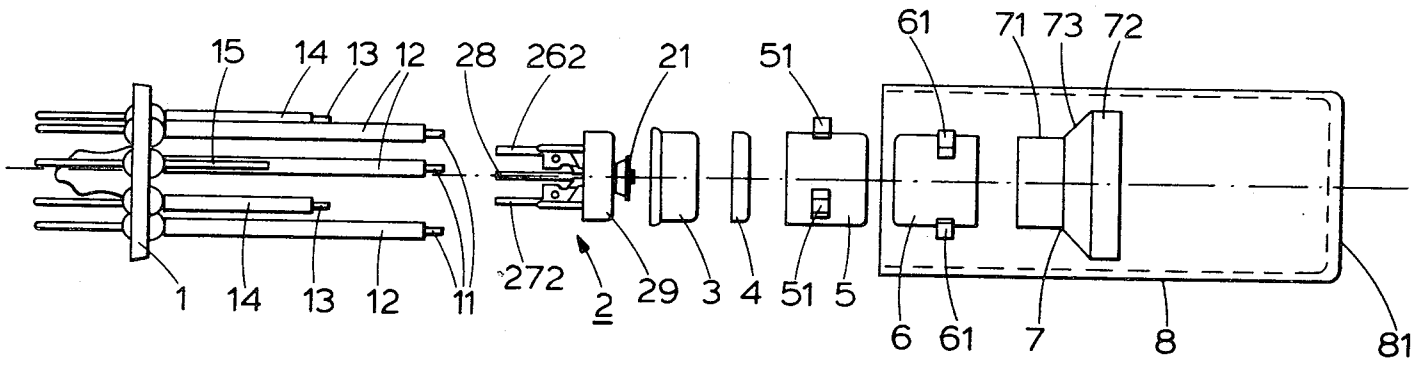

The invention relates to an electric arc discharge lamp comprising a cathode, an anode, means for applying an electrical potential between the cathode and anode to cause an electrical arc discharge therebetween, and a refractory metal diaphragm located between the cathode and anode, the diaphragm having an aperture to restrict the area over which the discharge occurs.

UK Pat. No. 1486514 shows a discharge lamp comprising a lamp bulb which has a window which is highly permeable to the relevant range of wavelengths emitted by the arc discharge. The interior of the bulb is filled with a mixture of deuterium and krypton. The discharge is effected between a heated cathode and an annular anode. The arc discharge is concentrated by the aperture so that a particularly intensive radiation is delivered through the window.

In order to produce an intense localized discharge it is necessary for the aperture of the annular anode to have a small diameter. As a consequence the anode is made relatively small and thus has a small surface area and has little heat radiating capacity. Consequently the heat generated by the arc will cause the temperature of the anode to increase to a relatively high temperature which makes the use of refractory metals for the anode necessary if a reasonable life for the lamp is to be achieved.

It is an object of the invention to provide a discharge lamp in which an intense discharge may be produced without requiring the use of a refractory metal anode.

The invention provides an electric arc discharge lamp comprising a cathode, an anode, means for applying an electrical potential between the cathode and anode to cause an electrical arc discharge therebetween and a refractory metal diaphragm located between the cathode and anode, the diaphragm having an aperture to restrict the area over which the discharge occurs, characterised in that the anode has a large radiating surface area so that under normal operating conditions its temperature increase is limited to a value which enables the anode to be formed from a non-refractory metal.

The limited temperature increase of the anode enables the anode to be formed from a non-refractory metal such as stainless steel. Thus a less expensive lamp may be produced without reducing the intensity of the discharge and hence the intensity of the radiation emitted.

The anode may comprise a cup shaped member having an aperture in its closed end mounted with its closed end facing the diaphragm so that the apertures are aligned. This provides a convenient construction which has good heat radiating properties yet is comparatively compact.

The cathode may be surrounded by a second cup shaped member, the cup shaped member comprising a substantially tubular member the diaphragm being assembled within the tubular member to form the closed end of the cup shaped member. The cup shaped member performs two functions. The first is to screen the cathode from the anode to prevent discharges via paths other than through the aperture in the diaphragm and the second is to reduce the running temperature of the diaphragm by increasing the heat radiating surface area.

In order to increase the heat dissipation of the anode an outwardly flared extension may be provided which projects from the open end of the anode.

The lamp may be enclosed in a substantially cylindrical envelope having leads extending through one end thereof and a radiation transparent window in the opposite end so that the axis of symmetry of the anode is parallel to or lies on the longitudinal axis of the envelope and the open end of the anode is adjacent to the opposite end of the envelope. This enables the anode to be supported by leads extending inwardly from the one end of the envelope and gives a relatively simple and robust construction. The inwardly extending leads may pass through ceramic tubes at least over the portion adjacent to the gap between the diaphragm and the anode. This reduces the possibility of discharges between the leads and the cathode or diaphragm.

When it is desired to produce radiation in the ultraviolet waveband the envelope is filled with deuterium.

An impregnated cathode may be used which may give a longer life and a more stable output than the directly heated cathode filaments used in previously known lamps.

Figure 2:
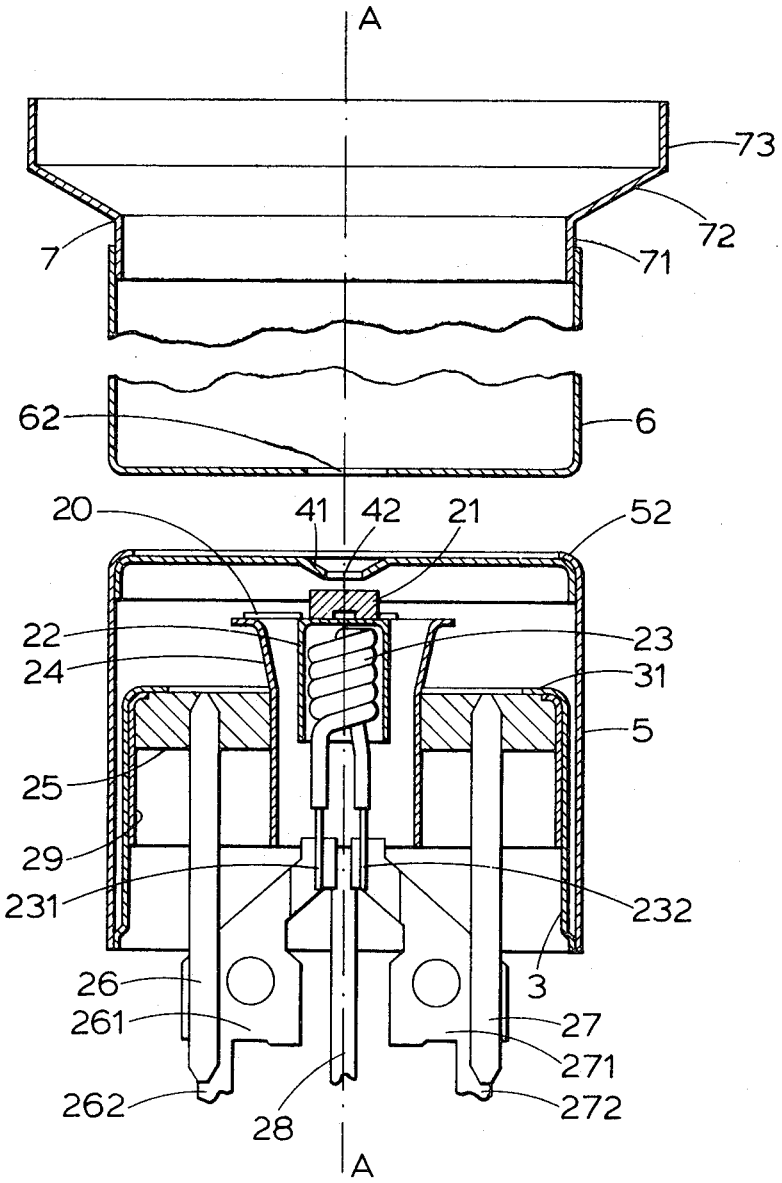
Figure 3:
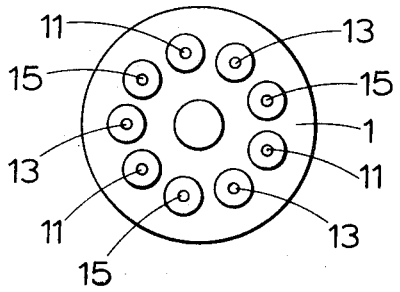
Figure 4:
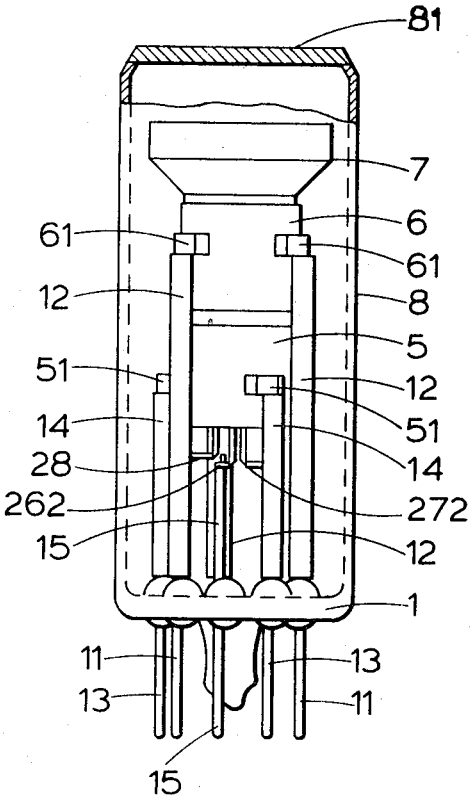

An embodiment of the invention will now be described, by way of example, with reference to the accompanying drawings in which:

FIG. 1 shows an exploded elevation of an electric arc discharge lamp according to the invention, FIG. 2 shows in cross-section the assembled cathode diaphragm and anode of FIG. 1, FIG. 3 shows an inverted plan view of an electric arc discharge lamp according to the invention, and FIG. 4 shows an elevation of the lamp shown in FIG. 3.

FIG. 1 is an exploded elevation of an electric arc discharge lamp which comprises a base 1, a cathode assembly 2, a substantially tubular member 3, a diaphragm 4, a substantially tubular member 5, a cup shaped anode 6, an anode extension 7, and an envelope 8.

The base 1 carries three leads 11 which are surrounded over most of their length by ceramic tubes 12, three further leads 13, two of which are shown, surrounded by ceramic tubes 14, and three leads 15, one of which is shown.

The cathode assembly 2 is shown on a larger scale and in more detail in FIG. 2. An impregnated cathode pellet 21 is mounted on the end of a metal can 22 which encloses a heater coil 23. The can 22 is mounted within an electrically conducting generally tubular member 24 by means of three equally spaced wires 20, of which only one is shown, which extend radially between the members 22 and 24 to minimize the heat conduction between the members whilst establishing an electrical connection between them. The member 24 is mounted in a ceramic disc 25 which also carried two terminal pins 26 and 27. A further terminal pin 28 is welded to the tubular member 24 and serves to form an electrical connection to the cathode pellet 21 via the wires 20 and metal can 22. The ceramic disc 25 is surrounded by a metal skirt 29. The cathode heater 23 is connected to the terminal pins 26 and 27 via metal plates 261 and 271 and helically coiled leads 231 and 232, this construction being used to minimize heat conduction and still provide rigid support for the heater. The metal plates 261 and 271 are welded to the pins 26 and 27 respectively and are provided with tails 262 and 272 for connection to two of the leads 15 while terminal pin 28 is connected to the third lead 15.

The diaphragm 4 is made from a refractory metal such as molybdenum and as can be seen in FIG. 2 has a central depression 41 with a central aperture 42 of approximately 1 mm diameter.

The member 5 is of stainless steel and has tabs 51 welded to it, into which the leads 13 are inserted. The member 5 receives the diaphragm 4 and when assembled they form a cup shaped member.

The anode 6 comprises a cup shaped member which because of the greater heat dissipating qualities of this configuration compared with previously known configurations may be made from a non-refractory metal, for example stainless steel. The anode has tabs 61 welded to it which receive the leads 11 and has a central aperture 62 (FIG. 2) of approximately 3 mm diameter.

The anode extension 7 comprises two tubular portions 71 and 72 joined by a truncated conical portion 73. The portion 71 is welded to the inside of the anode 6 in order to increase the radiating area of the anode and thus further decrease its operating temperature.

In one embodiment the cup shaped member was formed as a hollow right circular cylinder closed at one end except for the aperture 62. The diameter of the cup was approximately 12 mm and its height approximately 12 mm. The anode was fitted with a flared extension 7 the outer tubular portion of which had a diameter of approximately 20 mm and a height of 2 mm. The truncated conical portion 73 had a height of approximately 3 mm.

The envelope 8 is substantially tubular and is formed with a synthetic quartz window 81 in one end wall, the window 81 being substantially transparent to at least a selected portion of the radiation produced by the arc.

FIGS. 3 and 4 show the assembled lamp. The diaphragm 4 is assembled within the tubular member 5 to form therewith a cup shaped member. The cathode assembly 2 is assembled within the tubular member 3 and inserted into the cup shaped member formed by the tubular member 5 and diaphragm 4. By arranging that the bottom of the tubular member 3 is aligned with the bottom of the tubular member 5 as viewed in FIG. 2, the distance between cathode and diaphragm may be accurately set since it is determined by the dimensions of the cathode assembly 2 whose skirt 29 abuts against a turned over lip 31 on the tubular member 3, the dimensions of the diaphragm 4 which abuts against a turned over lip 52 on the tubular member 5, and the dimensions of the tubular member 3. All these members may be formed by tools giving a required dimensional accuracy. The cathode and diaphragm assembly is then assembled onto the base and the leads 13, which have been sleeved with ceramic tubes 14 are inserted in the tabs 51 and welded thereto. At the same time the leads 28; 262 and 272 are connected to the leads 15. It would, alternatively, be possible to connect the lead 28 and either the lead 262 or the lead 272 internally to one of the leads 13 where the diaphragm 4 is to be held at the same potential as the cathode. However, in some applications it may be desired to switch the lamp by varying the potential on the diaphragm in which case it is necessary to electrically isolate the cathode and diaphragm.

The anode extension 7 is welded within the anode 6 and the assembled anode and extension is mounted on leads 11 by the tabs 61. This assembly is then inserted in the envelope 8 and the base 1 sealed to the envelope. The sealed envelope is then evacuated and filled with deuterium to a pressure of 13 millibars.

In operation an electrical potential is connected between the anode and cathode to cause an electric arc discharge to occur. This discharge is confined to the depression in the diaphragm 4 and radiation from the arc passes through the window 81 via the aperture 62 in the anode. In the case of a deuterium lamp the emission occurs in the ultra-violet region of the spectrum and at a lower intensity at the blue end of the visible spectrum. If the envelope 8 is of glass the blue radiation will be visible through the sides of the envelope but the envelope will be substantially opaque to the ultra-violet radiation except through the window 81.

The flared anode extension 7 may be provided with transverse baffles having successively greater diameter apertures to confine the emitted radiation to a desired solid angle which may be that subtended by the window 81 from the anode aperture 62.

As can be seen from FIGS. 2 and 4 of the drawings the axis of symmetry of the anode 6 lies on the longitudinal axis of the envelope 8 as does the aperture 42 in the diaphragm 4. Consequently the major emission of radiation is along the longitudinal axis of the envelope. However, some currently used lamps emit the radiation in a direction transverse to the longitudinal axis. Consequently the lamp described in the embodiment may not readily fit into current spectrophotometers. These lamps are commonly used to provide a wideband radiation source for spectrophotometers. However, it would be possible to construct a lamp in accordance with the invention with electrode structure rotated through 90° and with the radiation transparent window 81 in the curved surface of the cylindrical envelope 8. This would necessitate a shorter electrode structure unless the envelope is of extended width. This could be achieved by increasing the dimension of the anode in the direction transverse to the axis of symmetry A—A shown in FIG. 2 and thus keeping a large radiating surface area in spite of reducing the height of the walls. The flared extension could also have a shallower profile. In that way a construction which would allow lamps in accordance with this invention to be used in the same instruments as conventional lamps could be obtained.

Various further modifications to the embodiment described may be made without departing from the scope of the invention, the following suggestions being illustrative only and not an exhaustive list.

The tubular member 5 may be made from molybdenum in which case the diaphragm 4 could be formed integrally with the member 5 to form the cup shaped member. Alternatively the diaphragm could be formed as a plate which is welded onto an apertured cup shaped member. The envelope may be filled with additional or alternative gases depending on the characteristics of the radiation required. A directly heated cathode filament may be used instead of the impregnated cathode 2 and the flared anode extension 7 may be omitted or be formed integrally with the anode. The anode may be formed in different configurations provided that the total effective radiating surface is such that its temperature increase during normal operation of the lamp is limited to a value below which the use of a refractory metal is necessary to achieve a reasonable operating life. Dish or saucer shaped anodes or even a planar anode could be used if a sufficiently large surface area can be provided within the envelope.

We claim:

1. An electric arc discharge lamp comprising a discharge vessel, an ionizable gas fill, a cathode, an anode, means for applying an electrical potential between the cathode and anode to cause an electrical arc discharge therebetween and a refractory metal diaphragm located between the cathode and anode, the diaphragm having an aperture to restrict the area over which the discharge occurs, the anode including means for limiting the temperature thereof, said means including a cup shaped member having an aperture in its closed end and mounted with its closed end facing the diaphragm so that the apertures are aligned, and an outwardly flared extension projecting from its open end.

2. A lamp as claimed in claim 1 in which the cathode is surrounded by a second cup shaped member, the second cup shaped member comprising a substantially tubular member the diaphragm being assembled within the tubular member to form the closed end of the cup shaped member.

3. A lamp as claimed in claim 1 or claim 2 in which the first mentioned cup shaped member or the first and second cup shaped members is or are hollow right circular cylinders closed at one end.

4. A lamp as claimed in claim 1 in which a baffle assembly is connected to the flared extension.

5. A lamp as claimed in claim 4 enclosed in an envelope having a radiation transparent window in which the baffles are formed to restrict the emission of radiation from the arc to substantially the area of the window.

6. A lamp as claimed in claims 1, 3, 4 or 5 enclosed in substantially tubular envelope having leads extending through one closed end thereof and a radiation transparent window in the opposite end, in which the axis of symmetry of the anode is parallel to or lies on the longitudinal axis of the envelope and the open end of the anode is adjacent to the opposite end of the envelope.

7. A lamp as claimed in claim 6 in which the anode is supported by leads extending inwardly from the one end of the envelope.

8. A lamp as claimed in claim 7 in which the inwardly extending leads pass through ceramic tubes at least over the portion adjacent to the gap between the diaphragm and the anode.

9. A lamp as claimed in claim 7 in which the inwardly extending leads are welded to the anode.

* * * * *